MECH SR
11/20/84 XR 4,483,683

United States Patent [19]

Alley, Sr.

[11] Patent Number: 4,483,683

[45] Date of Patent: Nov. 20, 1984

[54] SKI TOW SIGNAL ASSEMBLY

[76] Inventor: Ronald S. Alley, Sr., 200 Patricia La., Fayetteville, Ga. 30214

[21] Appl. No.: 405,941

[22] Filed: Aug. 6, 1982

[51] Int. Cl.[3] ..... A63C 15/06

[52] U.S. Cl. ..... 441/69; 114/253; 200/157; 340/502; 340/825.36; 340/696; 340/825.72

[58] Field of Search ..... 340/694, 696, 502; 441/69; D 8/DIG. 6; 200/161, 157; 114/314, 315, 253; 455/39, 73, 89

[56] References Cited

U.S. PATENT DOCUMENTS

| | | | |
|---|---|---|---|
| 3,021,513 | 2/1962 | Lankey | 114/253 |
| 3,091,757 | 5/1963 | Brock . | |
| 3,103,005 | 9/1963 | Hills | 441/69 |
| 3,109,075 | 10/1963 | Ratcliff | 200/161 |
| 3,122,609 | 2/1964 | Moore | 114/253 |
| 3,304,903 | 2/1967 | Emery | 441/69 |
| 3,345,568 | 10/1967 | Errichiello | 455/89 |
| 3,650,234 | 3/1972 | Goudy | 114/315 |
| 3,734,230 | 5/1973 | Tanaka . | |
| 3,754,187 | 8/1973 | Deming | 340/696 |
| 3,798,631 | 3/1974 | Langford | 340/502 |
| 3,805,003 | 4/1974 | Rennels . | |

*Primary Examiner*—Trygve M. Blix
*Assistant Examiner*—Patrick W. Young
*Attorney, Agent, or Firm*—Newton, Hopkins & Ormsby

[57] ABSTRACT

A radio receiver in a boat actuates a horn and a rotary strobe light when it receives an appropriate signal from a transmitter recessed in the handle of a ski rope. The actuation of the transmitter is controlled by a trigger on the handle.

13 Claims, 5 Drawing Figures

SKI TOW SIGNAL ASSEMBLY

BACKGROUND OF THE INVENTION

1. Field of the Invention

This invention relates to a ski tow signal assembly and is more particularly concerned with a tow rope handle and signal receiving assembly which will indicate to the operator of a boat, towing a person on skis, the condition of the person being towed.

2. Description of the Prior Art

In the past, numerous devices have been developed for signalling when a person being towed on water skis has fallen into the water. Usually such devices have included cables with special structures for connecting the cable to a boat. U.S. Pat. No. 3,091,757 and U.S. Pat. No. 3,798,631 are typical of devices of this type.

Such devices usually give an electrical signal when the skier is no longer being pulled by the rope and the rope, therefore, does not apply the appropriate pressure. U.S. Pat. No. 3,109,075 is typical of this type construction. Indeed, such devices have been employed for towing people, skiing on snow. U.S. Pat. No. 3,734,230 discloses such a device.

Signal controls which actuate horns have even been incorporated into the handle of a motorcycle. U.S. Pat. No. 3,805,003 discloses such a device.

None of the prior art discussed above permit anything but limited communication between a skier and the boat or vehicle which is towing the skier. None of these references teach a simple signalling device which can be used for more than one skier for a single boat.

None of these references teach signal devices which can be readily and easily transfered from one boat to the next and none of these references teach a signalling device which requires no special installation to the boat.

SUMMARY OF THE INVENTION

Briefly described, the present invention, which overcomes the deficiencies described above, includes a conventional tow rope or ski rope, the proximal end of which is connected in conventional fashion to a ski boat. The distal end carries a handle provided with a radio signal transmitter and a trigger wholly contained within the handle and by which the person skiing can signal the operator of the boat. The trigger is also a "dead man switch" which indicates by being no longer depressed, that the skier has fallen.

Within the boat is a radio signal receiver assembly which, when turned on, will receive the signals from the transmitter in the handle. When the trigger in the handle is depressed, the transmitter is cut "off" so that the receiver does not receive a signal. When, however, the receiver trigger is released, the transmitter transmits a signal to the receiver and the receiver closes a switch causing an audible sound to be made. If the trigger remains released for a prescribed time an internal time delay mechanism in the receiver assembly will turn "on" a strobe light, removeably mounted on the boat, to indicate to other boats in the area that a person, skiing, is in the water.

Accordingly, it is an object of the present invention to provide a ski tow signal assembly which is inexpensive to manufacture, durable in structure and efficient in operation.

Another object of the present invention is to provide a ski tow signal assembly which can be readily and easily used by a boat towing a plurality of skiers.

Another object of the present invention is to provide a ski tow signal assembly which will permit communication between a skier and the boat towing the skier.

Another object of the present invention is to provide a ski tow signal assembly which will signal other boats in the area when a skier has fallen into the water and is no longer being towed by the ski rope.

Another object of the present invention is to provide a ski tow signal assembly which will permit the skier to signal the operator of the boat to indicate to the operator when the skier desires to be towed and at what speed.

Another object of the present invention is to provide a ski tow signal assembly which can be quickly installed on a boat and removed from the boat when not in use.

Another object of the present invention is to provide a ski tow signal assembly which requires no special rope or fixture on the boat, to which the rope is attached.

Another object of the present invention is to provide a ski rope handle which is capable of transmitting signals from a skier to a remote receiver.

Other objects, features and advantages of the present invention will become apparent from the following description when taken in conjunction with the accompanying drawings.

DESCRIPTION OF THE PREFERRED EMBODIMENTS

Figure 1:
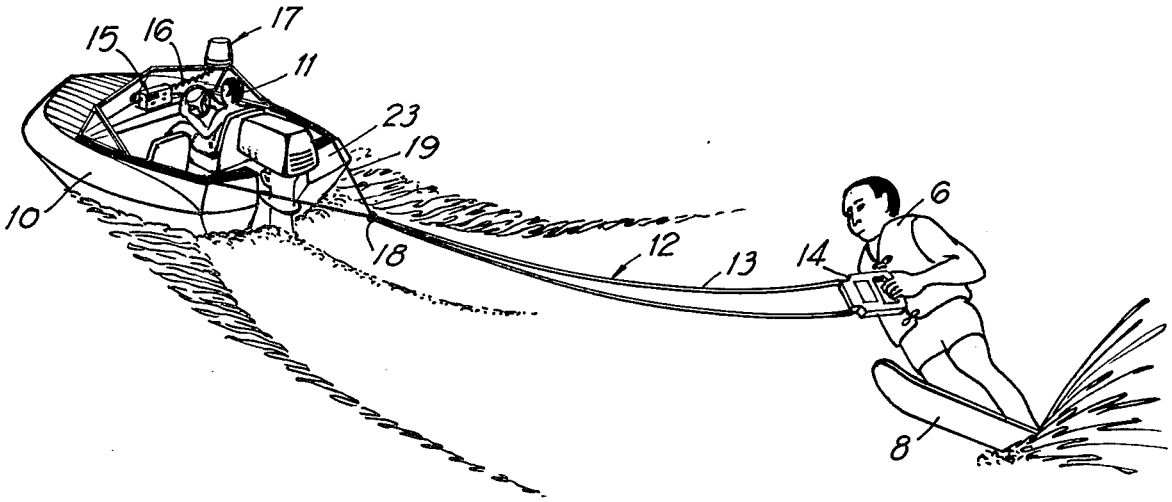
FIG. 1 is a perspective schematic view of a boat towing a skier and employing a ski tow signal assembly constructed in accordance with the present invention.
Figure 2:
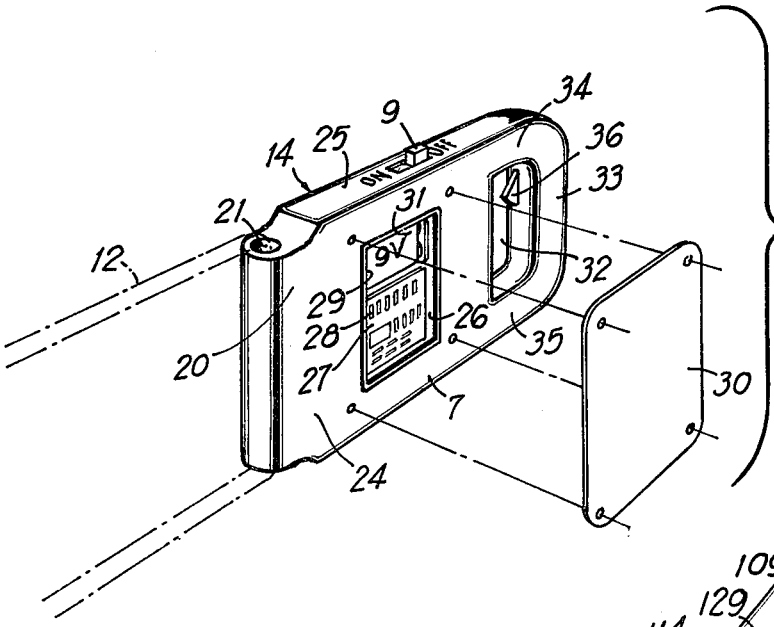
FIG. 2 is an enlarged, exploded, perspective view of the handle assembly of the ski tow signal assembly, depicted in Fig. 1.

Referring now in detail to the embodiment chosen for the purpose of illustrating the present invention, numeral 10 in Fig. 1 depicts a conventional boat 10 driven by a person or operator 11 and having installed thereon a conventional ski rope 12 secured by its proximal end to the transom 23 of the boat 10. At the distal end of the ski rope 12 is a split ski rope handle, denoted generally by the numeral 14, the handle or handle assembly 14 being constructed in accordance with the present invention. A skier 6 on a ski 8 or skis is towed while holding handle 14.

Mounted within the cockpit of the boat 10, preferably on the dashboard thereof or on a position accessible by the operator 11 is a radio signal receiver assembly, denoted generally by the numeral 15. The receiver assembly 15 is electrically connected through an electrical cable 16 to a strobe light assembly 17.

In more detail, the handle 14 is a generally rectangular, molded unitary plastic member having at its forward end a tow rope attachment block 20 provided with a vertically disposed hole 21 therethrough. The tow rope 13 illustrated, is a single strand of rope, an intermediate portion of which forms a distal end which loops through the hole 21 so that the end portions of the line lead to a common ring 18 which, in turn, slides on a length of line 19. The ends of line 19 are respectively secured to opposite sides of the transom 23 of the boat 12. Various other forms of tow ropes may be employed, if desired.

Rearwardly of the front block 20, the handle 14 has a pair of flat, parallel, vertical, side surfaces, such as surface 24, and a pair of horizontal top and bottom parallel surfaces, such as surface 25. The central portion or body 7 of the handle 14 is provided with a central, inwardly extending rectangular recess or chamber 26 which receives, therein, the transmitter 27. Recess 26 is open at side 24.

The transmitter 27 is of conventional construction and is of the type normally employed for opening and closing a garage door. Such a transmitter 27 has a plurality of code switches 28, each of which may be disposed in one of two positions. By manipulation of these switches 28, the transmitter 27 is tuned so that its signals will be received by a like tuned receiver 50 of assembly 15. The receiver 50, thus has like switches (not shown) which tune the receiver 50 for receiving the signals from the transmitter 27. An electric potential means or power source 1 such as dry cell battery 31, removeable within recess 26, supplies power for the transmitter 27.

It will be understood by those skilled in the art that the transmitter 27 is a very low powered transmitter which operates on the frequencies assigned for such apparatus by the FCC. The signal of transmitter 27 does not carry any appreciable distance beyond the length of the tow rope, but is sufficient to actuate the receiver 50.

Along the surface 24 surrounding the recess 26 is a rectangular gasket 29, over which is installed a removeable, flat, rectangular, closure plate 30. Bolts (not shown) removeably secure plate 30 against the gasket 29 so that the recess, chamber or cavity 26 is sealed against the entrance of water and the battery 31 and the transmitter 27 are, therefore, in a dry condition when the handle 14 is used.

Rearwardly of the recess 26, the handle 14 is provided with a hand hole 32, therethrough. Thus is provided a vertical gripping bar 33 at the rear portion of handle 14, the ends of gripping bar 33 being connected by arms 34 and 35 to the body 7 of the handle 14. The arms 34 and 35 extend parallel to each other and are received by the upper and lower portions of the body 7.

The gripping bar 33 is of a length greater than the width of a persons hand, when his fingers are inserted through the opening 32. The inner surface of gripping bar 33 is provided with a control means for the transmitter 27, such as a moveable, i.e., a depressible trigger 36 which is pivotally mounted within the gripping bar 33, adjacent to the upper arm 34, whereby, when the fingers of a person are inserted through the opening 32, the index finger or trigger finger of the person is disposed in a position to selectively depress and release the trigger 36. The trigger 36 is a switch, electrically connected to the transmitter 27, so that when trigger 36 is depressed, the transmitter is turned "off", but when the trigger 36 is released, the transmitter is turned "on". Therefore, the transmitter 27 will transmit signals at all times except when the trigger 36 is depressed. At the top surface 25 of the body 7, there is an electrical on/off switch 9, electrically connected to trasmitter 27, so as to cut the transmitter 27 "off" when it is not in use.

As pointed out above, the receiver assembly 15 is disposed on the dashboard of the boat. This receiver includes a housing case 40, mounted by suction cups 41 protruding from the bottom of case 40 to be received on the dashboard. Of course, the case 40 can be positioned anyplace in the boat 10 since it is a self contained unit.

The front panel 43 of the receiver assembly 15 is provided with a horn reset switch 44, a transducer horn 45 which generates an audio signal perceivable by the operator 11, a power on/off button switch 46 and a power on pilot light 47.

Figure 5:
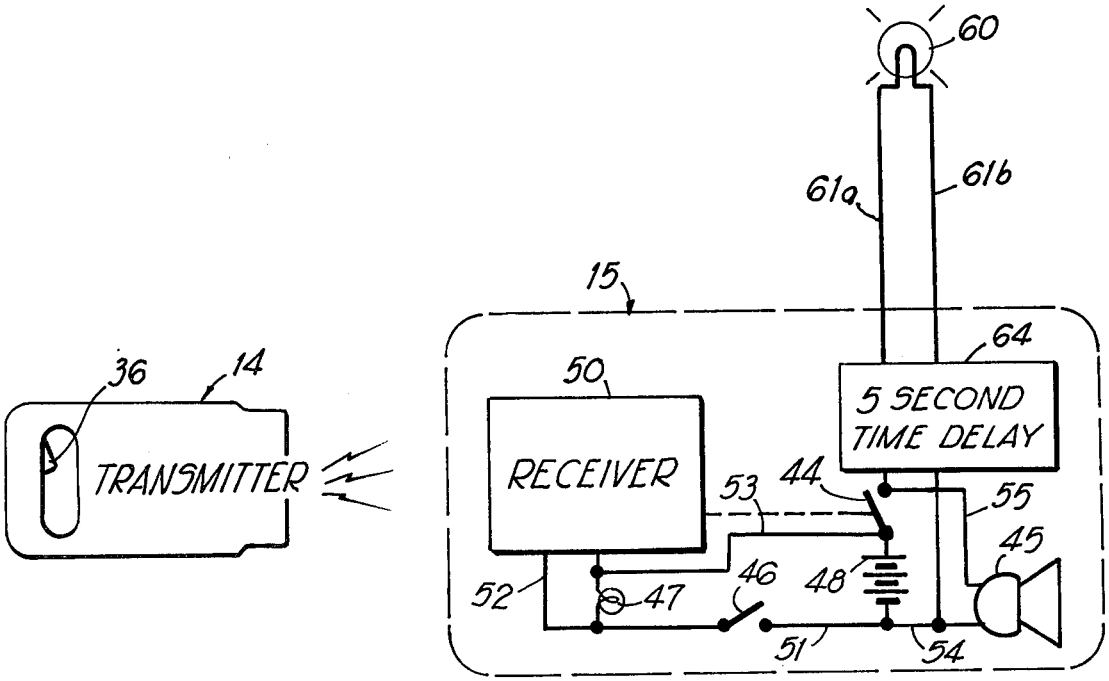
FIG. 5 is a schematic diagram of the transmitter and the receiver of the ski tow signal assembly depicted in FIG. 1.

As seen in FIG. 5, the source of power of the receiver assembly is a battery 48. The receiver 50 is connected in series with the switch 46 across the battery 48 via wires 51, 52 and 53. The power on pilot light 47 is arranged in parallel with the receiver 50. Thus, when the switch 46 is closed, the receiver 50 is energized and the liqht 47 is lighted.

The horn reset switch 44 when closed, will remain closed until it is manually opened. The horn 45 is arranged in series with switch 44, via wires 54 and 55. A second transducer such as a rotary strobe light 60 of strobe light assembly 17 is provided with cable 16 having wires **61*a* and 61*b* connected to a removeable plug 62. When the plug 62 is plugged into a socket 63, the strobe light 60 is connected through a five second time delay circuit 64, in parallel with horn 45. Therefore, when the switch 44 is closed, horn 45 is sounded immediately and the strobe light 60 will be lighted when the switch 45** has been closed for more than five seconds.

The strobe light 60 is enclosed in a transparent or translucent dome 68. The dome 68 is preferably a frusto conical or truncated cone shape member having a flat top and being removeably received by its open bottom on a disc shaped base 69 which carries light. The base 69 is provided on its bottom surface with a pivoted clamp 70, spring loaded by spring 71 to a closed position. The strobe light 60 is, therefore, mountable on suitable portions of the boat. When the assembly 15 is to be transported, the clamp 70 is inserted onto the bracket 42. When, however, the strobe light is in use, it should be mounted as high as possible on the boat 10, such as on a bracket (not shown) mounted to the upper edge of the windshield frame.

Figure 3:
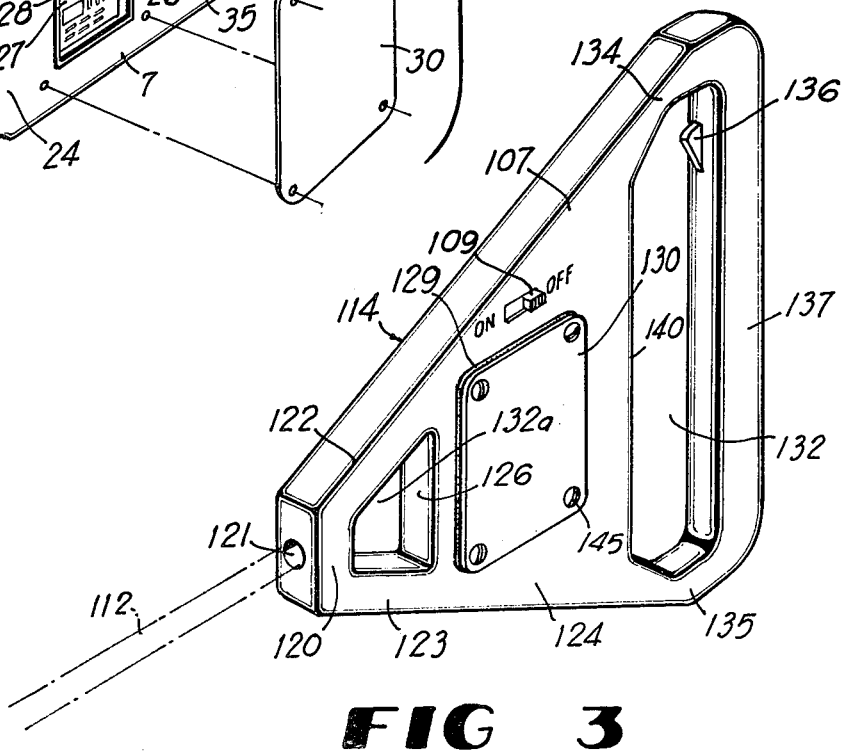
FIG. 3 is a perspective view of a second embodiment of the handle assembly of the ski tow signal assembly of the present invention.
Figure 4:
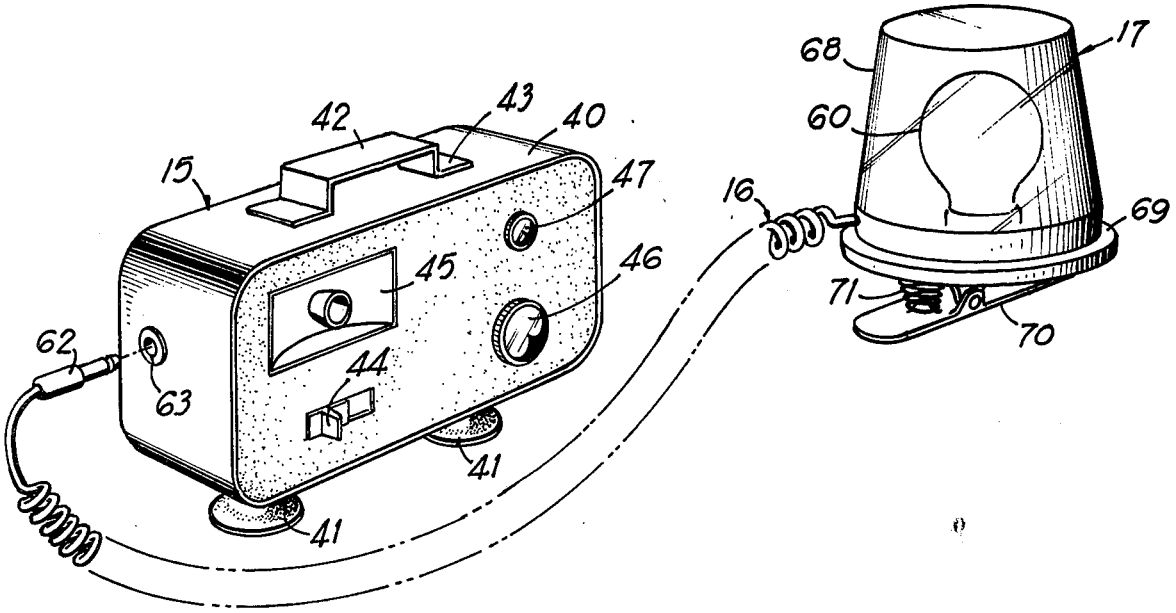
FIG. 4 is a perspective view of the receiver and the strobe light of the ski tow signal assembly of FIG. 1.

In FIG. 3 is shown a modified form of the handle assembly or handle assembly 114 of the present invention which is particularly suited for a single ski rope handle. This handle, 114 is generally triangular in shape and defines a hollow recess, cavity or chamber in its central portion, closed by a flat closure plate 130. Bolts 145 secure the plate 130 and its gasket 129 in place. The recess beneath the closure plate 130 is identical to recess 26 and carries a transmitter and battery (not shown) identical to the transmitter 27 and the battery 28. This transmitter (not shown) is connected to a trigger 136 which is operated in the identical way that trigger 36 is operated.

The housing or casing 114 includes a front block 120 which is carried by a pair of rearwardly diverging arms 122 and 123 which connect the forward edge 124, 126 of the central body 107 of the handle 114. Thus, the arms 122 and 123 space the block 120 forwardly of the front wall 126 so as to define a forward opening **132*a* transversely through the handle 114. The block 120 is provided with an axially or horizontally extending hole 121 which receives the distal end portion of the tow rope 112. Within the opening 132*a***, the end of the tow rope 112 is provided with a knot (not shown) which prevents the removal of the tow rope 112 through hole 121.

The handle 114 is provided with a pair of flat side surfaces disposed parallel to each other, such as side surface 124 and an upper and lower straight surface, such as surface 125, which tapers forwardly to the block 120. The rear portion of the body 107 of the handle 114 is provided with a pair of arms 134 and 135 which project rearwardly and support a gripping bar or hand grip 137 therebetween. The hand grip or gripping bar 137 is spaced rearwardly of the rear edge 140 of the body of the handle 114 to provide a hand hole or opening 132. The trigger 136 is pivotally mounted on the inner surface of the hand grip 137. The length of the hand grip 137 is sufficient that a person can insert one or both hands into the opening 132 so as to grasp the hand grip 137. One finger of the skier's hand can selectively depress the trigger 136.

The assembly depicted in FIG. 3 is provided with an on/off switch 109 which is identical to the on/off switch 9 of FIG. 1 but on a side of body 107. When the switch 109 is shifted to the on position, the transmitter of handle 114 is turned on. Thus, by manipulation of the trigger 136, signals may be sent to the receiver assembly 15.

From the foregoing description, the operation of the present invention should be apparent. The receiver assembly 15 is mounted, as described above, on the dashboard of the boat 10 and the strobe light 17 appropriately mounted so that its signals may be seen by any boats in the vicinity. The code switches, such as switches 28, are arranged so that the transmitter 27 will communicate with the receiver 50. The plate 30 is then installed covering the transmitter and the on/off switch, such as switch 46 or switch 9, is turned to the "on" positions. Thereafter, the skier 6, after he has installed his ski or skis 8, will usually grasp the handle 14 or 114 and depress and release the trigger 36 or 136 several times so as to transmit appropriate signals to the operator 11 to indicate to the operator how he should operate the boat 10. Each time the trigger switch 36 is released, the horn 45 will be sounded and heard by the operator because the receiver 50 closes switch 46. When the trigger 36 or 136 is depressed, no sound is heard from horn 45.

The skier 6 can use a code to indicate to the operator 11 to speed up or slow down the boat 10 and, when the skier 6 falls off, and he releases the handle 14, the trigger 36 or 136 will actuate the transmitter 27 to send a continuous signal to the receiver 50. This indicates to the operator 11 that the skier 6 has fallen off. After a five second delay, and in the event switch 46 is not opened, the time delay 64 will close the circuit to the strobe light 60, automatically. This indicates to the boats around boat 10 that it has a skier 6 in the water in the vicinity. The operator 11, when desired, can reset switch 44 by manually manipulating it. When switch 44 is reset, the strobe light 60 is cut off and so is the horn 45.

The strobe light 10 is usually visable for about 1 mile in the daytime and about 5 miles at night. Strobe light 60 is believed to be advantageous over a ski warning flag device which is required in some states because of its improved visibility.

With the device of the present invention, the boat 10 can tow a plurality of skiers, each with a handle assembly 14 or 114, the transmitter of each handle 14 or 114 tuned so that its signal can be received by the receiver 50. A plurality of boats using the device of the present invention can operate in the same vicinity since the code switches, such as switches 28, can program the transmitter 27 and receiver 50 so that it is unlikely that any two boats will have the same code and be in the same vicinity.

The device of the present invention is practical, economical and reduces to a minimum the likelihood of a person being drowned or becoming injured while skiing. No special equipment is required for installing the structure of the present invention on a boat and the structure can be readily and easily transfered from one boat to the other. It usually takes less than about 5 minutes to install the structure of the present invention on a boat and for it to become operative. No mechanical skills and no tools are required for this installation.

When a plurality of skiers are being pulled using the present device, any one of the skiers releasing his handle 14 or 114 will transmit a signal to actuate the receiver 50. The tangling of the ski rope around a propeller has no effect on the structure of the present invention, since the signals are transmitted through the air and not through the tow rope, itself. The strobe light 60 is not common to pleasure boats and therefore can be readily interpreted by other boats in the vicinity to indicate that a skier is in the water.

The handle 114 of FIG. 3 operates in the identical manner that the handle 14 operates and, therefore, no more detailed description of the operation of handle 114 is deemed necessary.

It will be obvious to those skilled in the art that many variations may be made in the embodiments here chosen for the purpose of illustrating the present invention, without departing from the scope thereof as defined by the appended claims.

I claim:

1. A ski rope handle assembly comprising:

(a) a handle having a body by which the handle may be secured to a ski rope and a gripping bar which is to be grasped by a skier, said body being forwardly of and spaced from said gripping bar, said handle also including arms extending between the ends of said gripping bar and said body, said body and said arms and said gripping bar defining an opening through which the fingers of the skier may be inserted;

(b) a wireless radio signal transmitter encased within said handle, for transmitting signals from said transmitter;

(c) control means on said handle, electrically connected to said transmitter for controlling the actuation of said transmitter for producing said signals, said control means including an on/off switch electrically connected to said transmitter for turning said transmitter on and off; and (d) a battery encased within said handle and electrically connected to said transmitter for providing a source of power for said transmitter, said transmitter and said battery being within said body, said electrical connection extending through one of said arms.

2. The handle assembly defined in claim 1 wherein said handle assembly is a molded unitary member, having a body essentially flat on one side and provided with a recess in its central portion, said transmitter being carried within said recess and a flat plate secured to said body and extending over said transmitter and said recess.

3. The handle assembly defined in claim 1 wherein said control means is a trigger moveably mounted on said gripping bar.

4. The handle assembly defined in claim 1 wherein said handle is provided with a recess therein and wherein said transmitter is carried within said recess, said recess opening to one side of said handle and a removeable plate disposed over said recess for preventing water from entering said recess.

5. The handle assembly defined in claim 1 wherein said handle is provided with a central body, a recess within said central body, said transmitter and said battery being carried wholly within said recess, and cover means for closing said recess and a gripping bar spaced rearwardly of and connected to said body, said control means being disposed in said gripping bar.

6. A ski tow assembly for towing a skier by a ski rope attached to and trailing from a vehicle, comprising:

(a) a handle assembly for connection to the distal end portion of said ski rope, said handle assembly having a gripping bar and a body in front of and spaced from said gripping bar, and arms extending between the ends of said gripping bar and said body, said body and said arms and said gripping bar defining an opening through which the fingers of the skier may be inserted;

(b) a wireless radio signal transmitter encased within said handle for transmitting signals;

(c) a battery encased within said handle and electrically connected to said transmitter for providing a source of power to said transmitter, said transmitter and said battery being within said body, said electrical connection extending through one of said arms;

(d) control means on said handle for controlling the actuation of said transmitter for producing said signals, said control means including an on/off switch electrically connected to said transmitter for turning said transmitter on and off, said control means being actuatable by said skier;

(e) a receiver assembly for location within said vehicle and including a radio receiver for receiving the signals by said transmitter; and (f) transducer means connected to said receiver for converting signals received by said receiver into signals perceivable by the operator of the vehicle.

7. The ski tow assembly defined in claim 6 wherein said handle is provided with a recess, said transmitter being received within said recess, and closure means for closing said recess.

8. The ski tow assembly defined in claim 6 wherein said handle means includes a gripping bar and wherein said control means includes a trigger on said gripping bar.

9. The ski tow assembly defined in claim 6 wherein said transducer means includes a horn electrically connected to said receiver and a rotatable light connected to said receiver said light and said horn being actuatable when said receiver receives signals from said transmitter.

10. The ski tow assembly defined in claim 9 including a time delay connected to said strobe light, said time delay delaying for a prescribed period of time the actuation of said strobe light after said horn has been actuated.

11. The ski tow assembly defined in claim 6 wherein said transducer means includes a strobe light, means for mounting said strobe light on said vehicle at a position spaced from said receiver assembly, and cable means connecting said receiver and said strobe light.

12. The ski tow assembly defined in claim 6 wherein said handle assembly includes a front block provided with a hole through which said ski rope is received and a gripping bar at the rear end of said handle assembly, there being provided an opening forwardly of said gripping bar, through which the fingers of a person's hand may be inserted, and wherein said control means includes a trigger electrically connected to said transmitter and mounted on or adjacent to said gripping bar for actuation by a finger of the hand of a person gripping said gripping bar.

13. The ski tow assembly defined in claim 12 wherein said transducer means includes a horn electrically connected to said receiver, and a light connected to said receiver, said horn and said light being actuatable when said trigger is no longer depressed by the person grasping said gripping bar.

* * * * *